United States Patent [19]

Kutik et al.

[11] 4,271,990

[45] Jun. 9, 1981

[54] PUMPING SYSTEM FOR DISPENSING PRODUCT FROM A CONTAINER

[75] Inventors: Louis F. Kutik, Ft. Lauderdale; Howard E. Cecil, Miami, both of Fla.

[73] Assignee: Security Plastics, Inc., Miami Lakes, Fla.

[21] Appl. No.: 905,380

[22] Filed: May 12, 1978

[51] Int. Cl.[3] ..... B05B 11/00

[52] U.S. Cl. ..... 222/321; 222/340; 222/385; 239/333; 417/541

[58] Field of Search ..... 222/259, 321, 340, 380, 222/382, 385, 464, 402.15; 239/329, 331, 333, 575, 590.3; 417/541

[56] References Cited

U.S. PATENT DOCUMENTS

| | | | |
|---|---|---|---|
| 3,138,331 | 6/1964 | Kutik | 222/402.15 X |
| 3,229,864 | 1/1966 | Roder | 222/321 |
| 3,923,250 | 12/1975 | Boris | 222/385 X |
| 4,029,261 | 6/1977 | Olegnowicz | 222/385 X |
| 4,033,487 | 7/1977 | Micallef | 222/324 X |
| 4,079,865 | 3/1978 | Kutik | 222/259 |

*Primary Examiner*—Robert J. Spar
*Assistant Examiner*—Frederick R. Handren
*Attorney, Agent, or Firm*—Oltman and Flynn

[57] ABSTRACT

This pumping system provides a continuous discharge of flowable product withdrawn from a container into a pressurizing chamber and pumped by a pressurizing piston there into a storage chamber just ahead of a stationary discharge nozzle. A spring acts on an accumulator piston in the storage chamber to maintain a more uniform pressure on the product there at different times in each operating cycle so as to obtain a substantially non-pulsating discharge of the product. The accumulator piston tends to move in the same direction as the pressurizing piston due to a frictional coupling acting on the accumulator piston. Air is more easily purged from this pumping system.

10 Claims, 10 Drawing Figures

PUMPING SYSTEM FOR DISPENSING PRODUCT FROM A CONTAINER

BACKGROUND OF THE INVENTION

My U.S. Pat. No. 4,079,865 and my U.S. patent application Ser. No. 851,277, now U.S. Pat. 4,146,155, show different novel and advantageous pumping systems for dispensing a liquid or other flowable product from a container. In both the pumping system has a pressurizing chamber for receiving the product from the container through a first check valve, a storage compartment for receiving the product from the pressurizing chamber through a second check valve, and a restricted discharge orifice for passing the product from the storage compartment. In U.S. Pat. No. 4,079,865 the pumping system is operated by a pivoted lever and in U.S. Pat. No. 4,146,155 the pumping system is operated by a reciprocable plunger, both manually actuated.

Both of the aforementioned pumping systems suffer from a tendency to produce a pulsating discharge of the product from the discharge orifice because of pressure variations in the storage compartment at different times during each cycle of operation of the manually actuated lever or plunger. A more nearly constant discharge of the product would be achieved if the pressure in the storage compartment were more nearly uniform throughout each operating cycle.

Also, with both of the aforementioned pumping systems difficulties sometimes arise when the user attempts to prime the system by purging it of air when it is used the first time. The air pressure developed by actuating the operating lever or plunger may be insufficient to uncover the outlet opening from the storage compartment to the discharge orifice.

In addition, in both of the aforementioned pumping systems the discharge orifice moves up and down during each operating cycle of the lever or plunger, and some users may find this objectionable.

SUMMARY OF THE INVENTION

The present invention is directed to a novel pumping systems which retains the advantages of my aforementioned systems and at the same time substantially eliminates the disadvantages associated with them.

An important object of the present invention is to provide a novel and improved manually actuated pumping system for dispensing a flowable product from a container in a substantially uniform, continuous, non-pulsating stream or spray.

Another important object of this invention is to provide in a manually actuated pumping system for dispensing a product from a container a novel and improved arrangement for purging the system of air as a preliminary to dispensing the product.

Another object of this invention is to provide novel and improved, manually actuated, product-dispensing pumping system for attachment to a container in which the pumping system has a discharge orifice that remains stationary with respect to the container throughout each cycle of operation of the pumping system.

Further objects and advantages of this invention will become apparent from the following description of two presently-preferred embodiments, shown in the accompanying drawings in which.

Figure 1:
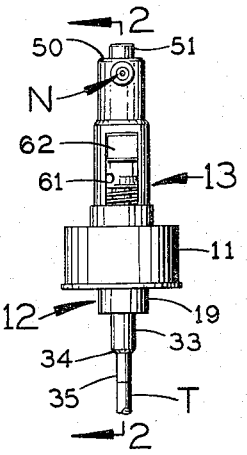
FIG. 1 is a front elevational view of a first embodiment of the present pumping system on the upper end of a dip tube for withdrawing flowable product from a container.
Figure 5:
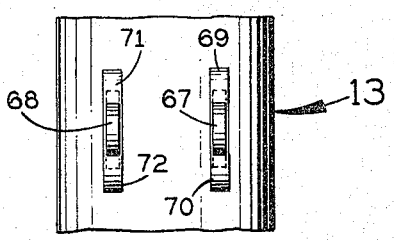
FIG. 5 is a fragmentary elevational view taken from the right side of FIGS. 2 and 4 at the operating lever.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

FIGS. 1-7

The mounting for the present pump includes an internally screw-threaded cap 11 for attachment to the externally threaded mouth of a container (not shown) which is filled with a liquid or other flowable product.

The present pump has a rigid two-piece housing consisting of a lower housing member 12 projecting down from the mounting cap 11 and an upper housing member 13 projecting up above the mounting cap. The lower housing member 12 provides a pressurizing chamber 14 (FIG. 2) for receiving product from the container. The upper housing member provides a storage chamber 15 for receiving product from the pressurizing chamber 14, as explained in detail hereinafter.

The lower housing member 12 has a flat, circular, transverse flange 16 at its upper end which has a snug fit against the underside of the top wall 17 of the mounting cap 11. An upper tubular segment 18 of the lower housing member 12 extends down from its top flange 16, and an intermediate tubular segment 19 of slightly smaller diameter extends down from the lower end of the upper tubular segment 18. One or more openings **19*a* in the intermediate segment 19 of the lower housing member provide fluid communication between its interior and the interior of the container just below cap 11**.

At the juncture between its upper and intermediate segments 18 and 19, the lower housing member 12 presents an upwardly-facing, annular, rounded shoulder 20 on the inside which provides a seat for the lower end of a first coil spring 21. The upper end of this spring engages beneath a transverse annular flange 22 extending out from a tubular stem 23 about midway along its vertical length.

A pressurizing piston 24 is slidably mounted inside the intermediate segment 19 of the lower housing 11. This piston has an outwardly and downwardly flared, annular skirt 25 which sealingly, but slidably, engages the inside of the intermediate housing segment 19. The piston 24 has a reduced, upwardly projecting neck 26 which is spaced inside the lower end of spring 21. The upper end of this neck abuts against a downwardly-facing, annular shoulder 27 on the hollow stem 23. Below this shoulder the stem 23 presents a reduced diameter segment 28 which extends down through the piston 24 with a tight fit. The piston is rigidly 24 fastened to the stem 23 so that they move in unison.

Inside the piston skirt 25 the stem presents an inwardly and downwardly tapered, frusto-conical segment 29 which provides an upwardly-facing seat for a ball valve 30. Below this tapered segment 29 the stem 23 terminates in a narrow, cylindrical, lower end segment 31.

The lower housing member 12 is formed with a reverse, inward and upward bend 32 at the lower end of its intermediate segment 19. A smaller diameter cylindrical segment 33 extends down from the upper end of this reverse bend concentric with the intermediate segment 19 and the upper segment 18 of the lower housing member 12. The lower end of this housing segment 33 is connected to a short, inwardly and downwardly tapered, frusto-conical segment 34, and a small diameter segment 35 of the lower housing member 12 extends down from this tapered segment 34. At its lower extremity the lower housing member presents a cylindrical nipple 36 of even smaller diameter which has a tight fit inside the upper end of the usual dip tube T, which extends down into the product container for withdrawing product from the container near the bottom.

At the juncture between its lower end nipple 36 and the adjoining segment 35, the lower housing member 12 presents an upwardly-facing, transverse, flat, annular, internal shoulder with a cylindrical inside edge 37 which provides a valve seat.

Figure 2:
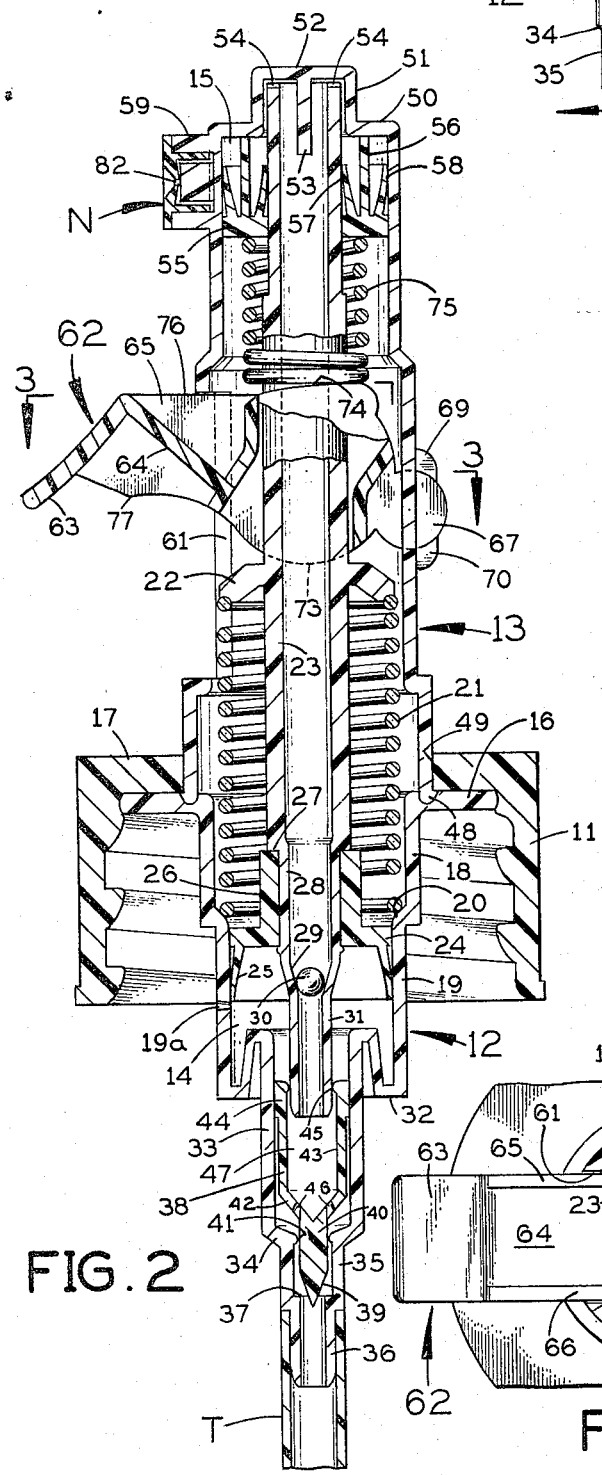
FIG. 2 is an enlarged vertical section taken along line 2—2 in FIG. 1 and showing the positions of the parts at the end of the intake stroke of the operating lever for this pumping system.

A lower check valve member 38 has a conical tip 39 on its lower end which is sealingly engageable with the valve seat 37 to block the flow of product up from the dip tube T. Above its lower end tip 39, the lower check valve 38 presents a solid cylindrical stem 40 which is slidably guided by rounded protrusions 41 on the inside of the lower housing member 12 at the inside of its tapered segment 34. Except at these protrusions 41 the valve stem 40 has a loose fit inside the segment 35 of the lower housing member 12. The protrustions 41 themselves are spaced apart circumferentially so that a flow passage is provided around the outside of the valve system 40 and through the spaces between the housing protrusions 41 when the lower check valve 38 is unseated from the lower valve seat 37, as shown in FIG. 2.

The upper end of the solid valve stem 40 is joined to an upwardly and outwardly tapered, hollow, frusto-conical segment 42 of the lower check valve 38. This tapered segment 42 is joined to the lower end of a cylindrical segment 43 of this valve which has a substantial clearance inside segment 33 of the lower housing member 12. The upper end of this cylindrical segment 43 of the lower check valve is joined to a cylindrical enlargement 44 which sealingly engages the inside of the housing segment 33 with a sliding fit. This cylindrical enlargement 44 carries a plurality of circumferentially spaced, rounded protrusions 45 on the inside which slidably engage the outside of the cylindrical lower end segment 31 of stem 23, so that this stem guides the lower check valve 38 and centers it properly with respect to the lower valve seat 37. The lower housing member 12 is generally cylindrical with different diameter segments.

The tapered segment 42 of the lower check valve 38 is formed with openings 46 for passing product up into its hollow interior 47, which leads up into the vertical passageway through the interior of the lower end segment 31 of the stem 23 to the upper valve seat 29 where the ball valve 30 is located. The interior chamber 47 in the lower check valve also communicates with the pressurizing chamber 14 through the spaces between the rounded protrusion 45 and the outside of the lower end segment 31 of stem 23.

The upper housing member 13 has a rounded bead 48 on its lower end which seats snugly in a complementary, upwardly-facing, circular groove in the top flange 16 of the lower housing member 12. This bead presents an upwardly-facing, narrow, annular, external shoulder with a snap fit beneath the top of the mounting cap 11 next to a central vertical opening 49 in the top of the cap which snugly receives the lower end of the upper housing member 13.

The upper housing member 13 is of generally cylindrical, stepped configuration, presenting a flat, transverse, annular wall 50 near its upper end which defines the top of the storage chamber 15. A short cylindrical extension 51 extends up from this transverse wall 50 and it is closed by a flat top wall 52 carrying a downwardly extending, internal rib 53.

The upper end of the hollow stem 23 has a large enough internal diameter to pass slidably up and down along the housing rib 53. The outside diameter of the upper end of stem 23 is small enough that it has a substantial clearance from the inside of the extension 51 at the top of the upper housing member 13. The top edge of the hollow stem 23 is formed with a plurality of circumferentially spaced slots or notches 54 which provide openings for the escape of product from inside the hollow stem 23 and the interior of the housing extension 51 and from there down around the outside of stem 23 into the storage chamber 15 when the upper end of the stem 23 abuts against the top wall 52 of the housing.

An annular accumulator piston 55 is snugly received between the outside of the hollow stem 23 and the inside of the upper housing member 13 below the latter's transverse wall 50. This piston defines the bottom of the storage chamber 15. The piston carries an upwardly extending, annular rib 56 which is engageable with the transverse housing wall 50 to limit the upward movement of this piston inside the upper housing member 13, as shown in FIG. 2. The accumulator piston 55 also has an upwardly and inwardly inclined, annular skirt 57 at the inside which sealingly engages the outside of the hollow stem 23 and an upwardly and outwardly inclined annular skirt 58 at the outside which sealingly engages the inside of the upper housing member 13 below the latter 's transverse wall 50. Both of these skirts terminate below the top edge of the stop rib 56.

The accumulator piston 55 has a relatively tight frictional engagement with the outside of the stem 23, for a purpose explained hereinafter. Also, this piston is frictionally restrained to some extent by its sealing engagement with the inside of the upper housing member 13.

At one side of the storage chamber the upper housing member 13 presents a short, outwardly protruding cylindrical neck 59. Openings 60 in the wall of the housing member 13 lead into swirl passages in a two-piece spray nozzle N seated in this neck. This spray nozzle provides a restricted product-discharge orifice 82 which is small enough to control the rate at which product can be discharged, so as to insure a continuous discharge of product during both the intake and pressurizing strokes of the present pump.

Figure 3:
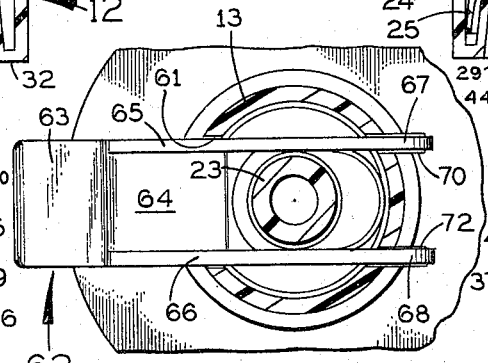
FIG. 3 is a horizontal cross-section taken along the line 3—3 in FIG. 2 at the operating lever.

At the same side as the neck 59 which receives the discharge nozzle N the upper housing member 13 is formed with a rectangular, vertically elongated opening 61 which slidably passes a pivoted, bifurcated operating lever 62. This operating lever has a curved outer end segment 63 at the left side of the upper housing member in FIGS. 2–4 for engagement by the user's forefinger or middle finger and a connecting web 64 extending substantially perpendicularly inward from the outer end segment 63. The operating lever presents opposite parallel sides 65 and 66, located on opposite sides of the web 64 and extending perpendicularly above and below it. These sides 65 and 66 of the operating lever pass on opposite sides of the stem 23 above its transverse flange 22, as best seen in FIG. 3, and they terminate at the opposite side of stem 23 in circular ears 67 and 68, respectively. These ears have a snap fit in corresponding openings in the opposite side of the upper housing member 13 from the aforementined opening 61. Above and below the ear 67 on the lever, the housing member 13 presents upper and lower, outwardly projecting protrusions 69 and 70 which engage the ear 67 from above and below and support it rotatably. Similarly, upper and lower protrusions 71 and 72 on the housing member 13 engage and support the other lever ear 68 in the same fashion.

Figure 4:
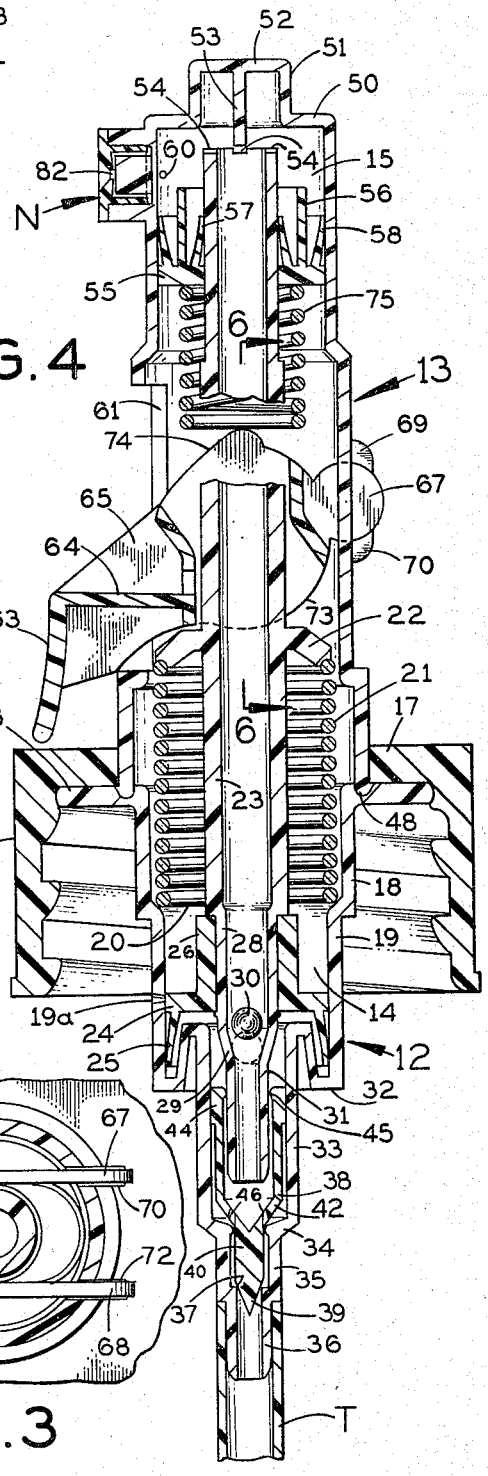
FIG. 4 is a view similar to FIG. 2 but showing the positions of the parts at the end of the pressurizing stroke of the operating lever.

With this arrangement the lever 62 is pivotally mounted on the upper housing member 13 for movement between a normal, raised or retracted position (FIG. 2) and a depressed or actuated position (FIG. 4).

The opposite sides 65 and 66 of the lever have identical rounded surfaces 73 on the bottom which slidably engage the top of the transverse flange 22 on the stem 23. Also, each of these sides 65 and 66 of the lever presents a cam surface 74 at the top. A second coil spring 75 is engaged under compression between these identical cam surfaces 74 on the top of the operating lever 62 and bottom of the accumulator piston 55.

Each side of the lever 62 presents a flat top face 76, to the left of its cam surface 74 in FIG. 2, which engages the upper housing member 13 at the top of its opening 61 to provide a limit stop for the lever when it is retracted (FIG. 2). Likewise, each side of the lever has a bottom edge 77 which engages the upper housing member 13 at the bottom of its opening 61 to provide a limit stop for the lever when it is actuated manually.

OPERATION

In the operation of this pumping system, with the cap 11 closing the top of the product container and the dip tube T extending down into the container, the operating lever 62 is repeatedly pivoted counterclockwise from the FIG. 2 position to the FIG. 4 position, first to purge the system of air and fill it with product from the container, and thereafter to dispense the product through the dicharge nozzle N.

When the operating lever 62 is in its retracted position (FIG. 2), the lower coil spring 21 urges the stem 23 upward along the upper housing member 13, and the frictional engagement between the outside of stem 23 and the accumulator piston 55 tends to position the latter in its uppermost position, with its upwardly projecting rib 56 abutting against the transverse housing wall 50.

During the upstroke of the stem 23 to the FIG. 2 position, as the pressurizing piston 24 moves up in unison with stem 23 along the inside of the lower housing member 12, product flows up through the dip tube T past the lower check valve 38 into the pressurizing chamber 14 inside the lower housing member 12 below the pressurizing piston 24. The flow path of the product during this intake stroke is as follows: up past the lower valve seat 37, around the outside of the valve stem 40, between the rounded protrusions 41 on the inside of the lower housing member 12, through the openings 46 in the lower check valve 38, up along the interior 47 of this check valve, and between its rounded protrusions 45 and around the outside of the lower end segment 31 of stem 23 into the pressurizing chamber 14.

When the operating lever 62 is actuated pivotally from its retracted position (FIG. 2) toward its pressurizing position (FIG. 4), it forces the stem 23 downward due to the engagement of the rounded bottom surfaces 73 on the lever against the top of the transverse flange 22 on the stem. The depending skirt 25 on the pressurizing piston 24 closes the opening or openings 19*a* in the lower housing member 12 and upon continued downward movement it applies pressure to the product in the pressurizing chamber 14. This holds the lower check valve 38 seated on its valve seat 37 and it causes the upper check valve 30 to move up away from its valve seat 29. Product is forced from the pressurizing chamber 14 up through the longitudinal passageway in the hollow stem 23 and into the storage chamber 15 at the upper end.

During the downward movement of the stem 23, the accumulator piston 55 tends to move downward substantially in unison with it because of the frictional engagement between them. That is, as the stem 23 moves down, it exerts a downward pull on the accumulator piston 55. The curvature of the cam surfaces 74 on the top of the operating lever 62 is such that it enables the lower end of the spring 75 to move down a distance which is somewhat less than the distance of downward movement of the stem. Consequently, the length of this spring between the operating lever and the accumulator piston will not vary appreciably at different times during each cycle of operation, and this spring will be exerting a substantially uniform pressure on the product in the storage chamber 15. As the stem and the lower abutment for spring 75 move down, spring 75 will lengthen, and its upward bias on piston 55 will be reduced. When the fluid pressure above the piston 55 is great enough to overcome the upward bias of spring 75 and the frictional drag of the piston 55 against the cylinder and the stem, the piston 55 will move down from its upper abutment. The curvature of the cam surfaces 74 on the lever is designed to compensate, at least partially, for the upward slippage of the accumulator piston along the stem and thereby eliminate or substantially reduce the expansion of spring 75 during the pressurizing stroke.

As the accumulator piston 55 moves down, its outer skirt 58 uncovers the openings 60 for passing product from the storage chamber 15 to the discharge nozzle N.

Figure 8:
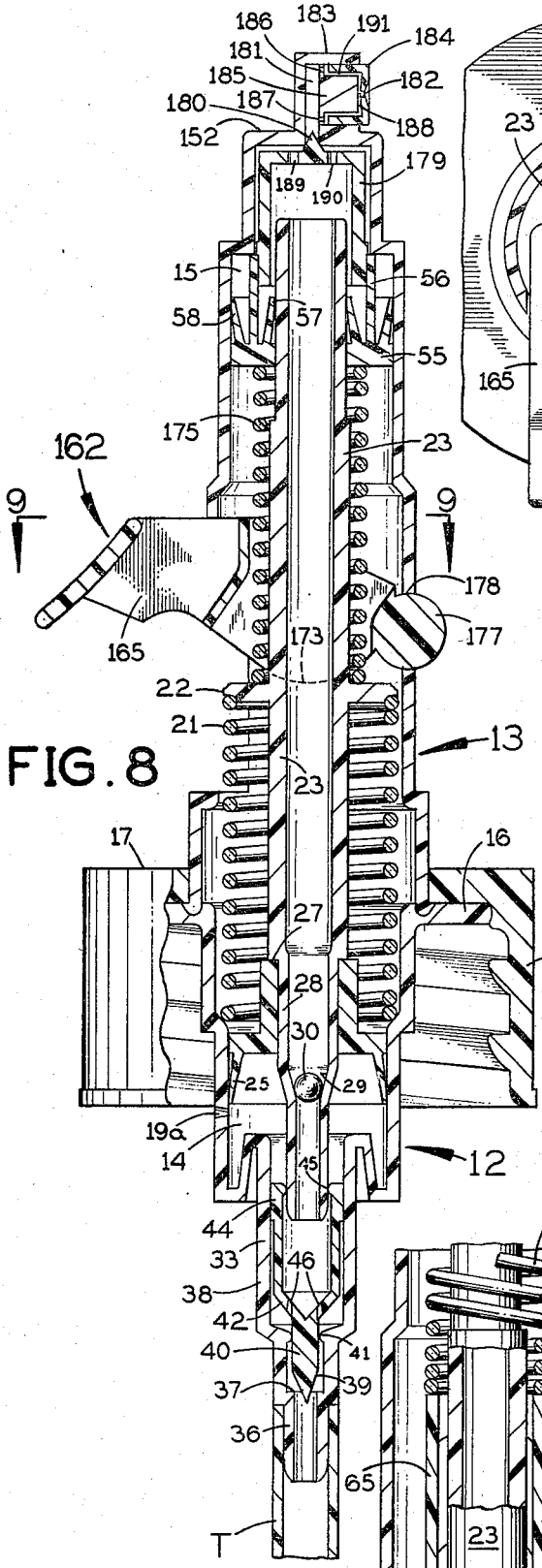
FIG. 8 is a vertical section through a second embodiment of this invention, showing the positions of the parts at the end of the operating lever's intake stroke.
Figure 9:
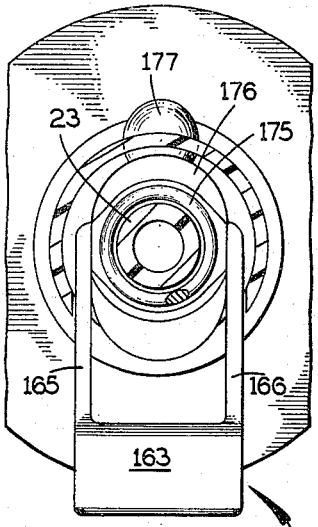
FIG. 9 is a cross-section taken along the line 9—9 in FIG. 8.
Figure 10:
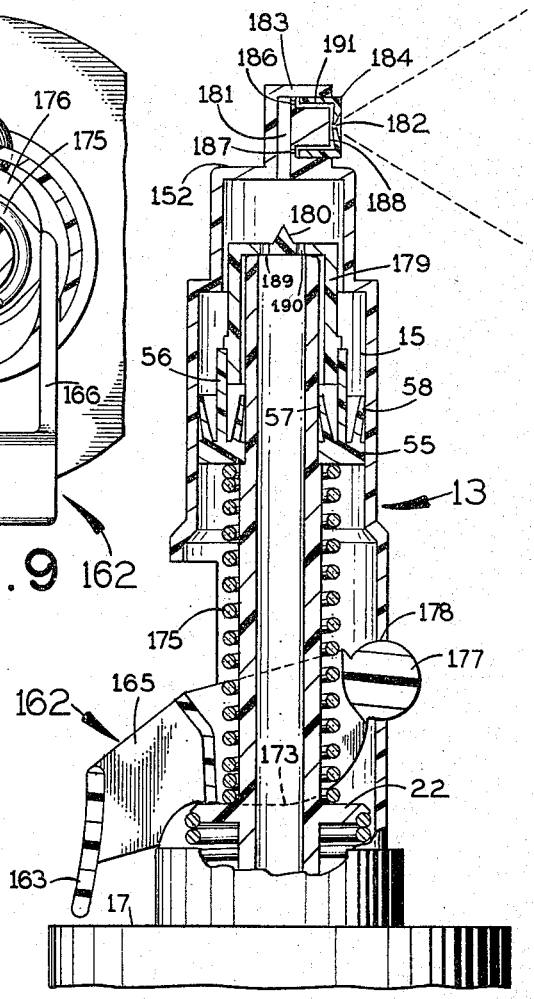
FIG. 10 is a vertical section through the upper end of the FIG. 8 pumping system with the product being dispensed from its discharge nozzle.
Figure 6:
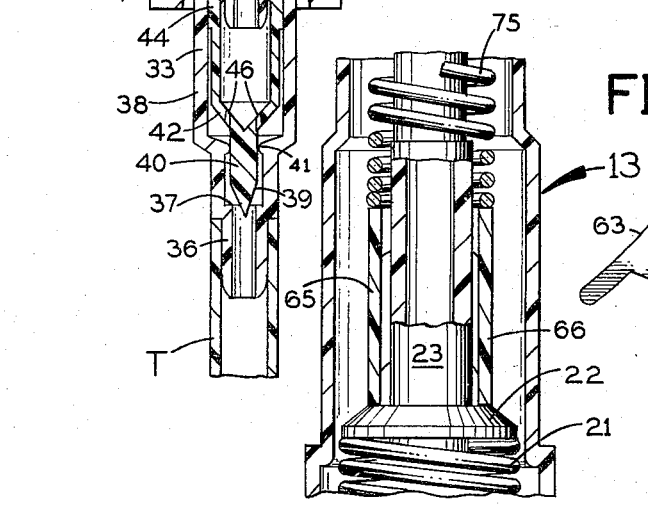
FIG. 6 is a fragmentary vertical section taken along the line 6—6 in FIG. 4.
Figure 7:
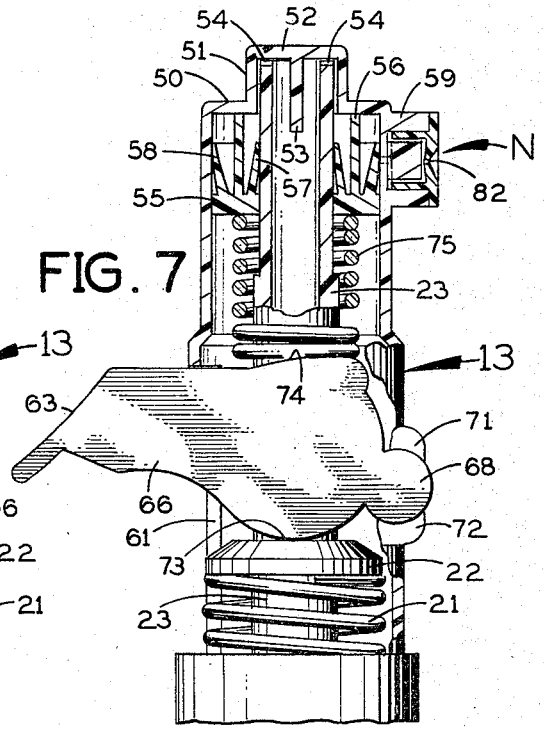
FIG. 7 is a fragmentary vertical section showing the apparatus in the same position as FIG. 2 except that the housing has been swiveled to put the discharge orifice on the opposite side from where it is shown in FIG. 2.

FIGS. 8–10 illustrate a second embodiment of the invention having an operating lever which preferably is operated by the user's thumb instead of his or her forefinger. Elements of the pumping system of FIGS. 8 to 10 which are substantially identical to those of the pumping system of FIGS. 1 to 7 are given the same reference numerals and will not be described again in detail.

Referring to FIG. 8, this embodiment differs from the first one in that the spring 175 which acts on the accumulator piston 55 extends down through the trigger or operating lever 162 and bears directly against the top of the transverse flange 22 on the hollow stem 23. The opposite arms 165 and 166 (FIG. 9) of the operating lever 162 straddle the spring 175 and the stem 23. The arms 165 and 166 merge together at the outward end 163 of the lever 162 and also merge together at the inward end 176 of the lever. At the inner end 176, there is a ball 177 which snaps into a corresponding recess 178 in the upper housing member 13 to form a pivotal connection between the trigger 162 and the housing member 13. The lower curved portions 173 of the trigger arms 165 and 166 engage the transverse flange 22 on the hollow stem 23 to operatively couple the trigger 162 to the stem 23. The spring 175 is also operatively coupled to the stem 23 at the flange 22.

The storage piston 55 has the same construction in FIGS. 8–10 as the corresponding piston in FIGS. 1–7, but the piston 55 in FIGS. 8–10 has a valve-carrying extension 179 with a valve projection 180 for opening and closing the outlet opening 181 that communicates with the discharge orifice 182. The top 152 of the upper tubular housing member 13 has an upward extension 183 which receives a spray nozzle 184 in which the discharge orifice 182 is formed. There is a wall 185 inside the housing extension 183 in which two small openings 186 and 187 are formed, and a plug 188 extends from the wall 185 toward the nozzle 184. There are also openings 189 and 190 in the valve-carrying extension 179.

Product which is pumped up through the hollow interior of the stem 23 tends to push the storage piston 55 down so that the valve 180 opens the outlet opening 181. The product enters the outlet opening 181, passes through the openings 186 and 187, flows through the space 191 around the outside of the plug 188, and exits through the discharge orifice 182. The resulting spray is shown schematically in FIG. 10. It may be noted that the spray nozzle 184 is stationary relative to the pumping system.

An important feature of the embodiment of FIGS. 8–10 is that as the trigger 162 pushes the stem 23 down, the frictional coupling between the stem 23 and the storage piston 55 as well as the pressure of product on the storage piston 55 tends to move the storage piston 55 down along with the stem. The storage piston 55 and the flange 22 move roughly the same distance as the stem 23 goes down, so the spring 175 remains at about the same length and the pressure on the storage piston 55 remains constant. As the trigger is allowed to rise due to the pressure of the spring 21, the stem and the storage piston 55 tend to move together upward such that the spring 175 stays at approximately the same length. Thus, a substantially constant pressure is kept on the storage piston 55 both during the pressurizing stroke and the intake stroke of the pumping system, thus tending to keep the spray or stream emerging from the orifice 182 relatively steady and non-pulsating.

Thus, in both embodiments of the invention, the spring which applies pressure to the storage piston keeps a relatively constant pressure on the storage piston for maintaining a relatively steady, non-pulsating stream or spray from the pumping system both on the pressurizing stroke and the intake stroke of the pumping system.

In both embodiments, the restricted outlet orifice in the spray nozzle is restricted sufficiently to control the rate of product discharge through the orifice so as to allow only a portion of the pressurized product to be dispensed from the pumping system during the pressurizing stroke of the pumping system, when pumping relatively rapidly. The remainder of the product is stored in the storage compartment to be dispensed during the subsequent intake stroke of the pumping piston by contraction of the storage compartment. This maintains the stream or spray from the orifice when the pressurizing pump is receiving product on its intake stroke.

The storage compartment includes an outlet opening which is opening 60 in FIG. 4 that communicates with the discharge orifice 82, and which is opening 181 in FIGS. 8 and 9 that communicates with discharge orifice 182. The outlet opening in each embodiment is disposed relative to the storage piston of the pumping system so that it is opened and closed by movement of the storage piston, thereby completely controlling the flow to restricted orifices 82 and 182.

In both embodiments, the stem 23 has an intermediate portion at the flange 22, and the pressurizing spring 21 has an upper end portion operatively coupled to the intermediate flange 22 of the stem and a lower end portion operatively coupled to the lower cylindrical housing member 19. The storage spring has an upper end portion operatively coupled to the storage piston 55 and a lower end operatively coupled to the intermediate flange 22 on the stem 23. Thus, when the pumping system is pumping air during priming of the pump, the storage spring 75 and 175 tends to be extended during the pressurizing stroke of the pressurizing piston 24 to reduce the pressure of the storage spring 75, 175 on the storage piston 55 which then moves down to open the outlet opening 83, 181 and allows air to escape from the outlet orifice 82, 182 for aiding in priming the pumping system.

The storage piston 55 has two skirts 57 and 58. As previously mentioned, the skirt 57 frictionally engages the stem 23 and the skirt 58 frictionally engages the upper cylindrical housing member 13. The stem and the storage piston are relatively movable such that the friction of the skirt 57 with the stem 23 is only partially offset by the friction of the skirt 58 with the member 13. This reduces the effect of the friction on the pressure of the spring 75.

In both embodiments of this invention, the piston 24 and the member 19 constitute a first pressurizing piston and cylinder assembly, and the piston 55 and the member 13 constitute a second piston and cylinder assembly. The first piston and cylinder assembly 24, 19 together with the check valves 39 and 30 constitute a pressurizing pump for withdrawing a quantity of product from the container through the dip tube T and the first check valve 39 during an intake stroke of the pump and for pressurizing that quantity of product during a pressurizing stroke of the piston and cylinder assembly 24. The first piston and cylinder assembly is biased by the spring 21.

The second piston and cylinder assembly 55, 13 constitutes a storage compartment means which is expandable for storing under pressure determined by the piston and cylinder assembly a quantity of pressurized product received through the second check valve 30 from the pressurizing pump. The second piston and cylinder assembly is biased by the spring 75 or the spring 175 as the case may be.

The first piston 24 and the second piston 55 are operatively interconnected with each other by the hollow stem 23 for causing inter-related movements of both of the pistons in the same directions at substantially the same times when product is being dispensed from the pumping system. The first piston 24 and the second piston 55 are respectively biased by the first and second springs 21 and 75 which are both operatively coupled to the intermediate flange portion 22 on the stem 23 such that the second spring 75 or 175 as the case may be exerts a relatively steady pressure on the storage piston 55 when product is being dispensed from the pumping system.

We claim:

1. In a pumping system for use with a container for product and a dip tube to dispense product from the container through the dip tube, said pumping system including:

a manually actuated pressurizing pump including first and second check valves and a first spring-loaded piston and cylinder assembly for withdrawing a quantity of product from the container through said dip tube and said first check valve during an intake stroke and for pressurizing said quantity of product during a pressurizing stroke;

storage compartment means including a second spring-loaded piston and cylinder assembly expandable for storing under a pressure determined by said second spring-loaded assembly a quantity of pressurized product received through said second check valve from said pressurizing pump;

a discharge nozzle defining a restricted outlet orifice;

said storage compartment means being functionally located with said restricted outlet orifice at its outlet and said second check valve at its inlet from said pressurizing pump;

said restricted orifice controlling the rate of product discharge therethrough so as to allow only a portion of the pressurized product to be dispensed from said pump during the pressurizing stroke, when pumping relatively rapidly, the remainder of said product being stored in said storage compartment means to be dispensed during the subsequent intake stroke of said first spring-loaded piston by contraction of said storage compartment means to maintain the stream or spray from the orifice when the pressurizing pump is receiving product on its intake stroke;

said storage compartment means including an outlet opening in communication with said outlet orifice, said outlet opening being disposed relative to said second spring/loaded piston so that it is opened and closed by movement of the second spring-loaded piston thereby completely controlling the flow to the restricted orifice;

the improvement wherein:

said second spring-loaded piston and cylinder assembly includes a second spring acting at one end against said second piston to exert pressure on the product in said storage compartment means; and further comprising:

hollow stem means reciprocable during said intake and pressuring strokes, said stem means being frictionally coupled to said second piston and operatively coupled to said first piston so that said pistons tend to move substantially in unison during said intake and pressurizing strokes, said hollow stem means providing a passageway for the flow of product from said second check valve to said storage compartment means; and means operatively coupling the opposite end of said second spring in said second spring-loaded piston and cylinder assembly to said stem for movement of said spring substantially in unison with said stem;

said second piston being displaceable along said stem against the drag of the friction coupling to act on said second spring in the second spring-loaded piston and cylinder assembly and thereby compensate for pressure changes in said storage compartment means; and wherein said stem means has an intermediate portion; said first spring-loaded piston and cylinder assembly includes a first spring engaged between said intermediate portion of said stem means at its upper end and said first cylinder at its lower end;

said second spring in said second spring-loaded piston and cylinder assembly is operatively engaged between said intermediate portion of said stem means at its lower end and said second piston at its upper end; and said second piston is movable downward to open said outlet opening and upward to close said outlet opening;

whereby when said pumping system is pumping air during priming of said pump, the downward movement of said stem means during the pressurizing stroke of said first piston and cylinder assembly permits the lower end of said spring in said second spring-loaded piston and cylinder assembly to move down to reduce the pressure on said second piston and enables the latter to move down to open said outlet opening and allow air to escape from said storage compartment means to said outlet orifice for aiding in priming the pumping system.

2. The pumping system as claimed in claim 1 in which:

said second piston has a first resiliently flexible sealing skirt sealingly engaging said second cylinder and a second resiliently flexible sealing skirt sealingly engaging said stem means;

said stem means and said second piston being relatively movable such that the friction of said second sealing skirt with said stem means at least partly offsets the friction of said first sealing skirt with said second cylinder to thereby aid said second spring in overcoming the drag effect of the latter friction when the stem is moving up.

3. The pumping system as claimed in claim 2 in whhich said stem means is actuated by a trigger.

4. The pumping system as claimed in claim 3 in which said trigger has cam means formed thereon for engaging said lower end of said second spring for assisting in keeping said second spring at a relatively constant length during said pressurizing stroke and said intake stroke of said pump, said trigger serving to couple the lower end of said second spring to said intermediate portion of said stem means.

5. The pumping system as claimed in claim 3 in which said trigger and said second spring loaded piston and cylinder assembly have cooperating snap action means for snap fitting said trigger with said second cylinder.

6. The pumping system as claimed in claim 5 in which said snap action means includes a pair of ears on said trigger and a pair of recesses in said second cylinder.

7. The pumping system as claimed in claim 5 in which said snap action means includes a ball on said trigger and a recess formed in said second cylinder.

8. The pumping system as claimed in claim 2 in which said first check valve frictionally engages said stem means for opening and closing of said first check valve during said intake stroke and said pressurizing stroke respectively of said pump.

9. The pumping system as claimed in claim 2 in which said second piston of said second piston and cylinder assembly has a valve portion for opening and closing said outlet opening.

10. In a pumping system, the combination of:

a manually actuated pressurizing pump means including a first piston and cylinder assembly for withdrawing product on an intake stroke and pressurizing product on a pressurizing stroke;

storage compartment means including a second piston and cylinder assembly for storing product received from said pressurizing pump means;

a restricted outlet orifice communicating with said storage compartment means for causing product to be discharged through said orifice on both said pressurizing stroke and said intake stroke;

stem means operatively interconnecting said first and second pistons so that said pistons tend to move in the same directions at substantially the same times; and spring means for biasing said first and second pistons respectively;

said second piston having a first resiliently flexible sealing skirt sealingly engaging said second cylinder and a second resiliently flexible sealing skirt sealingly engaging said stem means;

said stem means and said second piston being relatively movable such that the friction of said second sealing skirt with said stem means at least partially offset the friction of said first sealing skirt with said second cylinder to thereby aid said spring means in overcoming the drag effect of the latter friction when said stem is moving upward.

* * * * *